US008221067B2

(12) United States Patent
Pagnier et al.

(10) Patent No.: US 8,221,067 B2
(45) Date of Patent: Jul. 17, 2012

(54) COMPACT MULTIPHASE PUMP

(75) Inventors: Philippe Pagnier, Saint-Clair du Rhône (FR); Abdul Rahman Akhras, Vénissieux (FR); Régis Vilaginés, Dhahran (SA); Jean Falcimaigne, Bois-Colombes (FR)

(73) Assignee: Institut Francais du Petrole, Cedex (FR)

( * ) Notice: Subject to any disclaimer, the term of this patent is extended or adjusted under 35 U.S.C. 154(b) by 735 days.

(21) Appl. No.: 12/297,503

(22) PCT Filed: Apr. 17, 2007

(86) PCT No.: PCT/FR2007/000641

§ 371 (c)(1),
(2), (4) Date: Apr. 14, 2009

(87) PCT Pub. No.: WO2007/119010

PCT Pub. Date: Oct. 25, 2007

(65) Prior Publication Data

US 2009/0311094 A1 Dec. 17, 2009

(30) Foreign Application Priority Data

Apr. 18, 2006 (FR) ..... 06 03377

(51) Int. Cl.
*F04D 29/44* (2006.01)
*F04D 29/54* (2006.01)

(52) U.S. Cl. ..... 415/199.2; 415/211.2

(58) Field of Classification Search ..... 415/199.2, 415/211.2; 416/185, 198 A
See application file for complete search history.

(56) References Cited

U.S. PATENT DOCUMENTS

| | | | | |
|---|---|---|---|---|
| 1,554,591 | A | 9/1925 | Oliver | |
| 4,851,282 | A | 7/1989 | Shimizu et al. | |
| 5,071,317 | A | 12/1991 | Leach | |
| 5,961,282 | A | 10/1999 | Wittrisch et al. | |
| 7,937,942 | B2 * | 5/2011 | Gobert et al. | 60/612 |
| 2002/0187037 | A1 * | 12/2002 | Lee | 415/1 |
| 2005/0186065 | A1 | 8/2005 | Wilson et al. | |
| 2006/0034689 | A1 * | 2/2006 | Taylor et al. | 415/211.2 |

FOREIGN PATENT DOCUMENTS

| | | |
|---|---|---|
| DE | 199 41 323 A1 | 3/2000 |
| EP | 0 671 563 B1 | 9/1995 |
| WO | WO 99/56022 | 11/1999 |

* cited by examiner

*Primary Examiner* — Chuong A Luu
*Assistant Examiner* — Nga Doan
(74) *Attorney, Agent, or Firm* — Antonelli, Terry, Stout & Kraus, LLP.

(57) ABSTRACT

Rotodynamic machine for compressing a multiphase fluid comprising at least one gas phase and one liquid phase.
The machine comprises at least one mobile wheel 6 rotating around an axis A-A', mounted in a housing 1, and at least one fixed wheel 7 secured to housing 1. Mobile wheel 6 comprises a hub fitted with at least two blades 20 so as to form at least two channels delimited by hub 8, housing 1 and two of said blades 20. The channels have a centrifugal part.
The length of one of the channels defined as the ratio of the volume of a channel to the maximum orthoradial area of said channel, measured in a plane perpendicular to the axis of rotation, ranges between 10 cm and 20 cm, and the ratio of the area of the largest orthoradial channel cross-section to the area of the smallest orthoradial channel cross-section is less than or equal to 3.

11 Claims, 3 Drawing Sheets

COMPACT MULTIPHASE PUMP

FIELD OF THE INVENTION

The present invention relates to the sphere of multiphase pumps allowing compression of a mixture of gas and of a possibly viscous liquid.

BACKGROUND OF THE INVENTION

Current rotodynamic multiphase pumps, for example as described in document FR-2,665,224, consist of the succession of several compression stages, typically five to fifteen stages. Each stage is made up of a mobile element, referred to as wheel or impeller, and of a fixed element referred to as straightener. The inlet and the outlet of each element is axial, which, by the nature of this geometry, gives the pumps a preferential working range corresponding to low values of pressure gain per stage in the range of relatively high flow rates. This type of pump is therefore particularly well suited for high-power compression stations. The pressure gain of such pumps can be increased by raising the number of stages or by increasing the rotating speed, which, according to the type of application, may unfortunately lead to machine floor space or reliability problems on industrial sites.

For applications corresponding to low flow rates and high pressure gains, the most commonly used concept for compressing mixtures of gas and liquid is the double-screw type positive-displacement pump. This technology however requires relatively frequent mechanical maintenance operations that may limit its use on isolated or hard-to-get-to sites such the ocean depths or oil wells.

The present invention provides a rotodynamic multiphase pump that notably allows compression of mixtures of gas and liquids in a working range that was previously reserved for pumps of double-screw or progressive-cavity (Moineau pumps) type, while escaping the problems inherent in positive-displacement pumps. The device according to the invention is a pump that can be a multistage pump whose mobile wheels comprise a limited number of blades and have a quasi-axial inlet and a semi-radial outlet.

SUMMARY OF THE INVENTION

In general terms, the present invention relates to a rotodynamic machine for compressing a multiphase fluid comprising at least one gas phase and one liquid phase. The machine according to the invention comprises at least one mobile wheel rotating around an axis, mounted in a housing, and at least one fixed wheel secured to the housing. Said mobile wheel comprises a hub fitted with at least two blades so as to form at least two channels delimited by the hub, the housing and two of said blades. Said channels have a centrifugal part.

The rotodynamic machine according to the invention is characterized in that the length of one of the channels defined as the ratio of the volume of a channel to the maximum orthoradial area of said channel ranges between 10 cm and 20 cm, the orthoradial area being measured between the leading edge and the trailing edge of the blades of the mobile wheel in a plane perpendicular to the axis of rotation, and in that the ratio of the area of the largest orthoradial channel cross-section to the area of the smallest orthoradial channel cross-section is less than or equal to 3, preferably less than or equal to 2.

According to the invention, the mobile wheel can comprise at least three channels, said channels having an orthoradial cross-section ranging between 2 $cm^2$ minimum and 30 $cm^2$ maximum.

The mobile wheel can comprise n equidistant blades distributed in the peripheral direction over an angular sector ranging between $2\pi/n$ radians and $4\pi/n$ radians.

Angle $\beta$ formed, in a tangential plane, by the projection of the line tangential to the mean direction of a channel of the mobile wheel and by the axis of rotation can be larger than 60°, preferably larger than 70°.

The inside radius of the housing measured at the trailing edge of the blades of said mobile wheel can be larger than said radius measured at the leading edge of the blades of said mobile wheel.

Angle $\delta$ formed in a meridian plane by the projection of the line tangential to the mean direction of a channel of the mobile wheel and the axis of rotation can range from a value lying between −20° and +20° at the leading edge of the blades of the mobile wheel to a value lying between 0.1° and 70° at the trailing edge of the blades of the mobile wheel.

The thickness of the blades of the mobile wheel, measured in a plane perpendicular to the axis of rotation, can be minimum at a radius smaller than 0.9 times the largest radius of the mobile wheel measured in said plane.

The machine according to the invention can comprise several mobile wheels linked to a single rotating shaft.

The fixed wheel can comprise a hub fitted with at least two blades and the distance between the blades of the mobile wheel and the blades of the fixed wheel is limited to a maximum value of 6 millimeters.

The channels of a fixed wheel delimited by the hub, the housing and the walls of the blades can have a centrifugal part and a centripetal part.

The fixed wheels can have at least twice as many channels as the mobile wheels.

The pump according to the invention allows to reach compression performances similar to those of axial multiphase pumps, but with a rotating speed reduced by about 30%.

BRIEF DESCRIPTION OF THE FIGURES

Other features and advantages of the invention will be clear from reading the description hereafter, with reference to the accompanying figures wherein.

DETAILED DESCRIPTION

Figure 1:
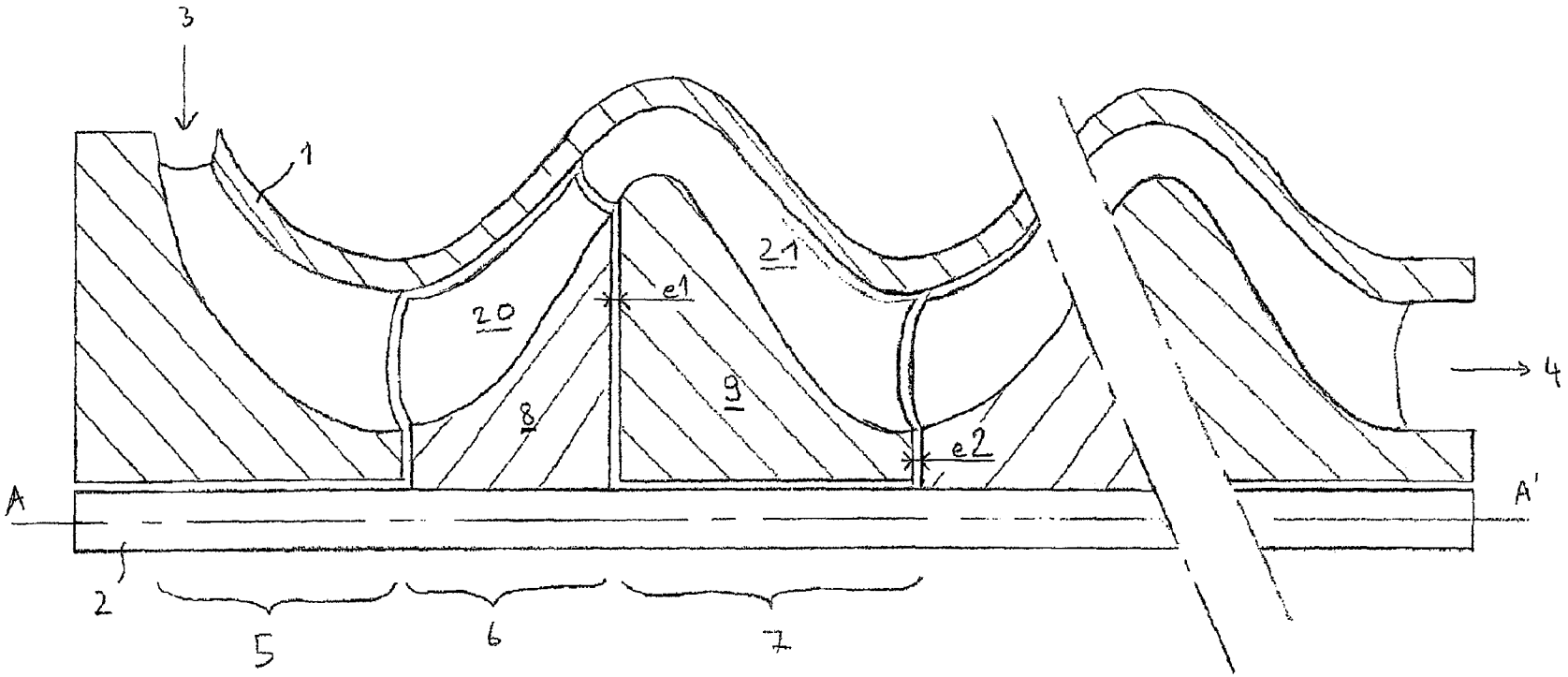
FIG. 1 shows, in axial section, a pump according to the invention.

The pump shown in axial section in FIG. 1 comprises at least one compression cell according to the invention. The elements of the pump are mounted within housing 1 and around shaft 2 rotating around axis A-A'. The fluid to be compressed is fed into the pump through inlet port 3.

The circulation of the fluid introduced through port 3 is suited to the pump by a first wheel 5 that is fixed in relation to housing 1.

Then, the total energy of the fluid is increased by means of the compression cell consisting of mobile wheel 6 and fixed wheel or straightener 7. Mobile wheel 6 is driven in rotation by shaft 2. Straightener 7 is fixed in relation to housing 1. The blading or blades of wheels 6 and 7 are diagrammatically shown in FIG. 2. Blades 20 are fastened to rotating hub 8 of wheel 6. There is a play between the end of blades 20 of wheel 6 and housing 1, allowing this wheel to freely rotate in stationary housing 1. Considering the peripheral direction, the n blades 20 of a wheel 6 extend preferably over an angular portion equal to $2\pi/n$ at least. Thus, the blades of wheel 6 partly overlap so as to form channels wherein the pumped fluid is forced to flow during a fraction of the rotation as it passes through mobile wheel 6. Fixed wheel 7 is provided with blades 1 secured to hub 9 of wheel 7 and to housing 1.

At the level of wheel 6, the fluid circulates in channels delimited by the hub of wheel 6, housing 1 and two successive blades 20 fastened to hub 8. A mobile wheel 6 thus comprises a number of channels equal to the number of its blades 20. These channels have a specific shape. More precisely, the inside radius of the channel, i.e. the outside radius of hub 8 of wheel 6, and the outside radius of the channel, i.e. the inside radius of housing 1 at the level of wheel 6, increase progressively from the inlet to the outlet of wheel 6. However, the height of the fluid section, i.e. the span of wheels 20, measured in the plane perpendicular to the axis of rotation of the pump, between hub 8 and housing 1, is small and it decreases progressively from the inlet to the outlet of the wheel. Thus, globally, the cross-section of flow in a channel increases so as not to be subjected to too great a deceleration of the fluid as it passes in mobile wheel 6.

The cross-section of a channel of a mobile wheel 6 can be defined by the characteristics presented hereafter.

The orthoradial cross-section Sr of the channels is the area defined by the intersection between an inter-blade channel of wheel 6 and a plane perpendicular to axis of rotation A-A' of the wheel. The variation of Sr between the inlet and the outlet of mobile wheel 6 can be defined by a function of the geometrical coordinate (z/L) measured along the axis of rotation, with z=0 in the wheel inlet section, i.e. at the level of the leading edges of wheel 6, and z=L in the wheel outlet section, i.e. at the level of the trailing edges of wheel 6.

The orthogonal cross-section Sf of the channels is the area defined by the intersection between an inter-blade channel and a plane perpendicular to the mean direction of the channel at the point considered. Cross-sections Sf are a good approximation of the normal cross-sections available to the fluid flowing in the channel between two successive blades of wheel 6.

Figure 2:
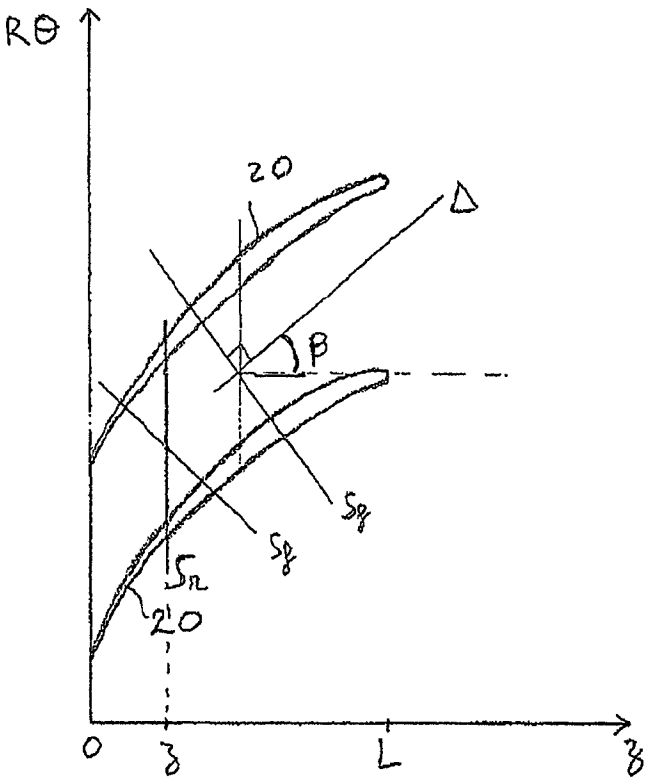
FIG. 2 is a developed view of the trace resulting from the intersection of the blades of a mobile wheel with a surface of revolution.

FIG. 2 shows the geometrical layout of blades 20 on the developed surface of a revolution envelope. Axis z represents the direction of axis of rotation A-A' and axis Rθ represents the peripheral direction that is perpendicular to axis A-A'. The planes containing the orthoradial Sr and orthogonal Sf cross-sections of a channel are shown in FIG. 2.

For any cross-section Sf, one can define a pair of angles (δ,β) where δ is the angle formed in the meridian plane (plane defined by the radius and axis of rotation A-A') by the projection of line Δ tangential to the mean direction of the channel and axis of rotation A-A' and, respectively, β is the angle formed in the tangential plane (plane defined by the peripheral direction and axis of rotation A-A') by the projection of line Δ and axis of rotation A-A'. The projection of line Δ on the meridian plane or the tangential plane is carried out in a direction perpendicular to the plane considered.

Figure 3:
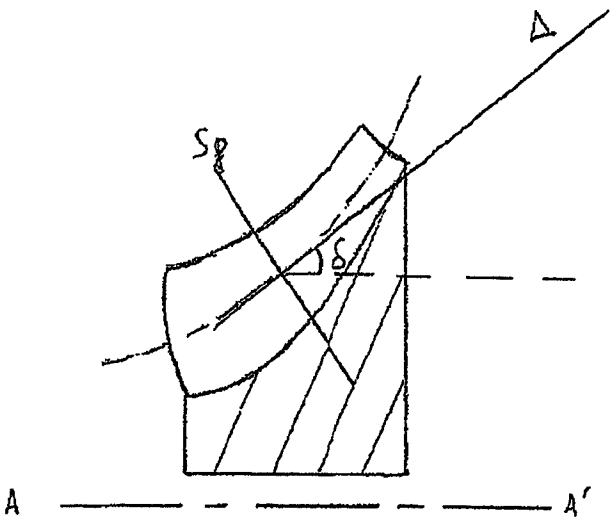
FIG. 3 shows, in axial section, a mobile wheel, FIGS. 4 to 7 diagrammatically show various blade profiles.

FIG. 2 shows an angle β formed by line Δ and the axis of rotation. Angle δ formed by line Δ and the axis of rotation can be seen in FIG. 3, which shows a mobile wheel 6 in axial section.

Cross-sections Sr and Sf, as well as angles δ and β, have to meet dimensioning criteria for a pump according to the invention to be obtained.

An important characteristic is that angle β can be larger than 60°, preferably larger than 70°, between the leading edge and the trailing edge of the blades of wheel 6.

Furthermore, angle δ can be limited in regions close to the inlet and the outlet of wheel 6. Preferably, the leading edge of the blades of wheel 6 is located in a zone where δ ranges between −20° and +20° in order to obtain a flow of substantially axial direction at the wheel inlet. Considering the great variety of possible shapes for the leading edges of the blades of wheel 6, it can be advantageous to select negative values for angle δ at the level of the inlet section of wheel 6. Such a layout is original because it corresponds to a mobile wheel 6 wherein the direction of flow is globally centripetal in the inlet region and progressively becomes globally centrifugal. From the viewpoint of the person skilled in the art, this characteristic is unfavourable to performances in compression of single-phase fluids, gaseous or liquid, and it is therefore never encountered in common turbomachines. In the case of the pumps according to the invention, it however has the advantage of allowing to obtain channels of sufficient length, favourable to the compression of gas-liquid mixtures, in a minimum axial space.

Furthermore, the leading edge of the blades of wheel 6 can be preferably selected in a zone where δ can range between 0.1° and 70° in order to prevent purely centrifugal flows at the outlet of the mobile wheels.

Correlatively, the area of cross-sections Sr and Sf varies so that channels of suitable length and equivalent hydraulic diameter are available to the gas-liquid mixture flowing through wheel 6. Experiments showed that the performance in compression of mixtures of gas and liquids is optimized in a variation range of Sr and Sf contained between 2 $cm^2$ and 30 $cm^2$, preferably between 2 $cm^2$ and 20 $cm^2$, at any point located between the inlet section and the outlet section of wheel 6. Appropriate characteristics can be obtained for cross-sections Sr and Sf by wisely selecting, on the one hand, the number and the thickness of the blades and, on the other hand, the shape of the fluid stream in the meridian plane.

Figure 4:
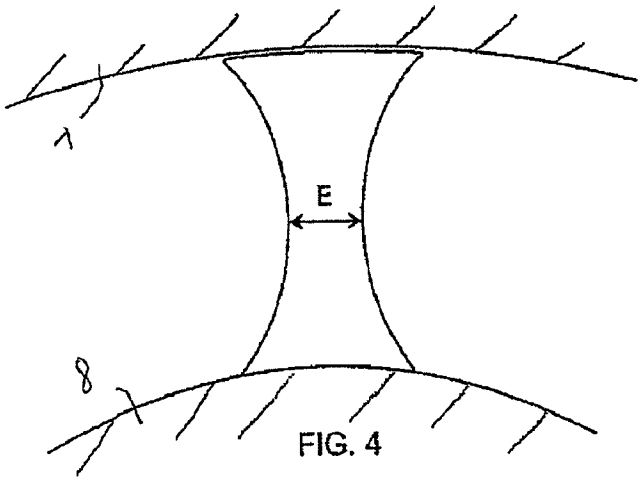
Figure 5:
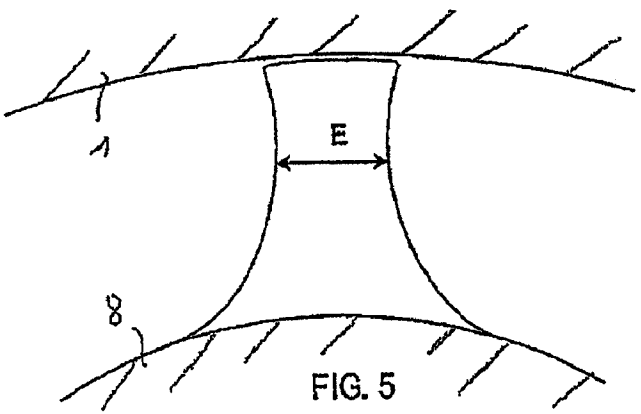
Figure 6:
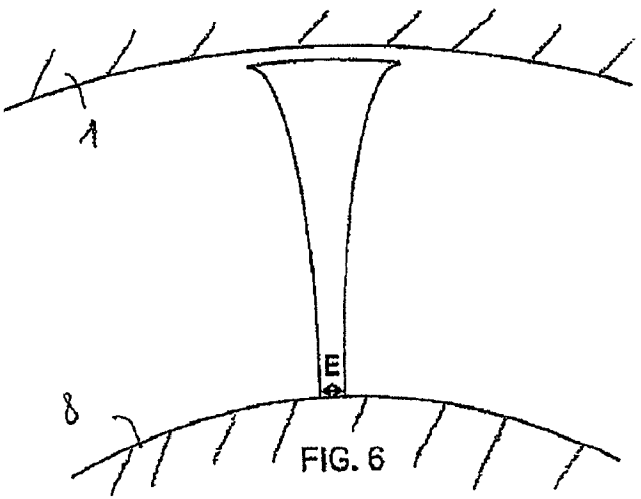
Figure 7:
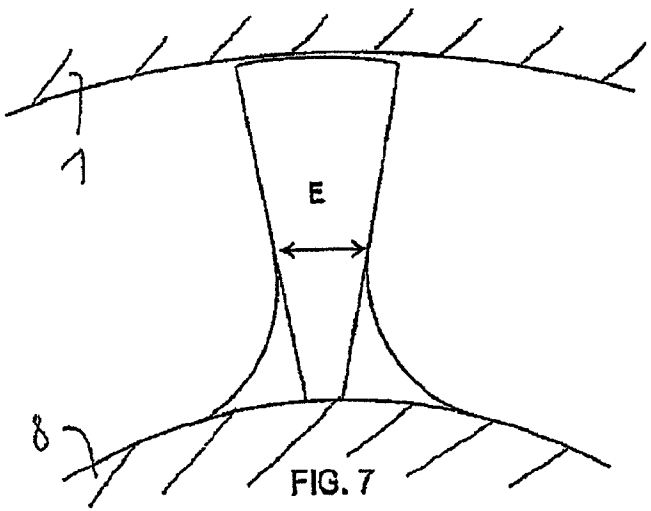

Advantageously, the thickness of blades 20 is defined so as to provide the channels of wheel 6 with orthogonal sections of oblong shape. This geometry allows to improve mixing of a two-phase fluid in the channels of the mobile wheel. Various geometries are shown in FIGS. 4 to 7 and listed by way of non limitative possible embodiment examples of the blades of mobile wheel 6 of the multiphase pump according to the invention. FIGS. 4 to 7 show the profiles of blades arranged between hub 8 and housing 1, seen in a plane perpendicular to axis of rotation A-A'. The minimum thickness of the profiles is shown by reference letter E. FIGS. 4 and 5 show for example a "mushroom" type blading, i.e. whose thickness measured at the end of the blade in an orthogonal cross-section is greater than the thickness of the blade measured at a smaller radius. FIG. 6 shows a thin foot blade profile with no fillet connecting the blade to hub 8. The minimum thickness E is located at the connection between the blade and hub 8. Alternatively, connection fillets can be used between the hub of the wheel and the blades having a non circular shape or a circular shape with a large radius, as shown in FIG. 7. The radius of these connection fillets can reach a maximum value equal to the span of the blade.

At the stage of the design of the blades of mobile wheel 6 of the pump according to the invention, these geometries can be defined by means of a law of blading thickness in the radial direction. This law of thickness in the radial direction allows to define the surface area of the blades at any point from a nominal blade thickness law established for example, in a non limitative way, according to the geometrical coordinate (z/L) at the end of the blades or at the hub. An original method of generating the geometry of the blades of wheel 6, well suited to the design of multiphase pumps according to the invention, is thus defined.

By way of example of the possible embodiments of wheel 6, it is possible to use the law of nominal thickness at the housing (denoted by $e_{housing}$) of an elliptical profile described along the axial direction according to the geometrical coordinate (z/L) by an equation of the form as follows:

$$\frac{(z/L - z_0/L)^2}{A^2} + \frac{(e_{housing} - e_0)^2}{B^2} = 1,$$

with A, B, $z_0$ and $e_0$ positive real numbers, coupled with a radial thickness law of the form $e(r^*)=(r^*-k)^2$ for defining $e_{housing}$ the thickness of the blading at the housing, then the thickness of the blading at any point of wheel 6 according to variable $r^*=(r-R_{hub})/(R_{housing}-R_{hub})$ and parameter k, ranging between 0 and 1.

At the level of wheel 7, the fluid circulates in channels delimited by hub 9, housing 1 and blades 21. In order to promote the flow of the mixtures of gas and liquid through the machine according to the invention, it is important to limit to the minimum diffusion of the flows in the unbladed parts between the mobile wheels and the fixed wheels. This provides the machine according to the invention with inter-blade channels of wheel 7 having original shapes. Preferably, the fixed wheel has a triple-curvature blading. More precisely, an inter-blade channel of wheel 7 comprises a first centrifugal part, followed by a second, centripetal part. In other words, in the first part, the inside radius of the channel, i.e. the outside radius of the hub of wheel 7, and the outside radius of the channel, i.e. the inside radius of housing 1, increase, then in the second part, the radius of the hub and the radius of the housing decrease progressively. The span of the blades increases progressively from the inlet to the outlet of fixed wheel 7. The cross-section of a channel of wheel 7 can be defined in a similar way to the channels of mobile wheel 6.

The trailing edge of the blades of wheel 6 is located at a distance e1 from the leading edge of the blades of wheel 7. Similarly, the trailing edge of the blades of wheel 7 is located at a distance e2 from the leading edge of the blades of the next wheel. According to the invention, these distances e1 and e2, commonly referred to as air gap clearances, are constant over the height of the blading. Advantageously, all the air gap clearances can be in the [0.1 mm; 6 mm] range.

The pump according to the invention can comprise several compression cells successively arranged along shaft 2.

After passage through the various compression cells, the fluid under pressure is discharged from the pump through discharge port 4.

The multiphase pump according to the invention finds a favourable application in the compression of mixtures of gas and liquid whose viscosity can be great. It therefore is an attractive option for the compression of petroleum effluents, in particular heavy crudes. Besides, the semi-radial multiphase pump, also referred to as mixed pump, can be used onshore, in isolated oil fields or offshore in deep sea water, in a subsea version, and more generally on isolated sites requiring little maintenance. Owing to its compactness, the pump according to the invention is also attractive for applications on offshore platforms. Finally, its use with a relatively low rotating speed can allow to use fixed-speed engines, notably less expensive and more reliable than variable-speed drive systems.

The invention claimed is:

1. A rotodynamic machine for compressing a multiphase fluid comprising at least one gas phase and one liquid phase, said machine comprising at least one mobile wheel rotating around an axis, mounted in a housing, and at least one fixed wheel secured to the housing, said at least one mobile wheel comprising a hub fitted with at least two blades so as to form at least two channels delimited by the hub, the housing and two of said at least two blades, said at least two channels having a centrifugal part, characterized in that a length of one channel of the at least two channels defined as a ratio of a volume of said channel to a maximum orthoradial area of said channel ranges between 10 cm and 20 cm, an orthoradial area being measured between a leading edge and a trailing edge of the blades of the at least one mobile wheel in a plane perpendicular to the axis of rotation, and in that a ratio of an area of the largest orthoradial channel cross-section at a position in the channel to an area of the smallest orthoradial channel cross-section at another position in the channel is less than or equal to 3.

2. A machine as claimed in claim 1, wherein said at least one mobile wheel comprises at least three channels, said channels having an orthoradial cross-section ranging between 2 $cm^2$ minimum and 30 $cm^2$ maximum.

3. A machine as claimed in claim 1, wherein said at least one mobile wheel comprises n equidistant blades distributed in a peripheral direction over an angular sector ranging between $2\pi/n$ radians and $4\pi/n$ radians.

4. A machine as claimed in claim 3, wherein an angle β formed, in a tangential plane, by a projection of a line tangential to a mean direction of a channel of the at least two channels of the at least one mobile wheel and by the axis of rotation is larger than 60°.

5. A machine as claimed in claim 1, wherein an inside radius of the housing measured at the trailing edge of the at least two blades of said at least one mobile wheel is larger than said radius measured at the leading edge of the at least two blades of said at least one mobile wheel.

6. A machine as claimed in claim 5, wherein an angle δ formed in a meridian plane by a projection of a line tangential to a mean direction of a channel of the at least one mobile wheel and the axis of rotation ranges from a value lying between −20° and +20° at the leading edge of the at least two blades of the at least one mobile wheel to a value lying between 0.1° and 70° at the trailing edge of the at least two blades of the at least one mobile wheel.

7. A machine as claimed in claim 1, wherein a thickness of the at least two blades of the at least one mobile wheel, measured in a plane perpendicular to the axis of rotation, is minimum at a radius smaller than 0.9 times the largest radius of the at least one mobile wheel measured in said plane.

8. A machine as claimed in claim 1, comprising several mobile wheels linked to a single rotating shaft.

9. A machine as claimed in claim 1, wherein said at least one fixed wheel comprises a hub provided with at least two blades and a distance between the at least two blades of the at least one mobile wheel and the at least two blades of the at least one fixed wheel is limited to a maximum value of 6 millimeters.

10. A machine as claimed in claim 1, wherein channels of a fixed wheel of the at least one fixed wheel delimited by a hub, the housing and walls of blades have a centrifugal part and a centripetal part.

11. A machine as claimed in claim 9, wherein the at least one fixed wheel has at least twice as many channels as the at least one mobile wheel.

* * * * *